US006975179B2

(12) United States Patent
Harris

(10) Patent No.: US 6,975,179 B2
(45) **Date of Patent: *Dec. 13, 2005**

(54) APPARATUS AND METHOD FOR IN-PROCESS HIGH POWER VARIABLE POWER DIVISION

(75) Inventor: George M. Harris, Auburn, ME (US)

(73) Assignee: RF Technologies, LLC, Lewiston, ME (US)

( * ) Notice: Subject to any disclaimer, the term of this patent is extended or adjusted under 35 U.S.C. 154(b) by 77 days.

This patent is subject to a terminal disclaimer.

(21) Appl. No.: 10/816,617

(22) Filed: Apr. 5, 2004

(65) Prior Publication Data

US 2005/0007211 A1 Jan. 13, 2005

Related U.S. Application Data

(62) Division of application No. 09/871,839, filed on Jun. 1, 2001, now Pat. No. 6,741,143.

(51) Int. Cl.[7] ..... H01P 5/12
(52) U.S. Cl. ..... 333/125; 333/135
(58) Field of Search ..... 333/111, 124, 333/135, 137

(56) References Cited

U.S. PATENT DOCUMENTS 5,656,980 A * 8/1997 Zimmerman ..... 333/208

* cited by examiner

*Primary Examiner*—Dean Takaoka

(74) *Attorney, Agent, or Firm*—Lightbody & Lucas

(57) ABSTRACT

A power divider for a waveguide between a single electromagnetic microwave generator input and two output ports, the divider including two tuner networks, each comprising a moveable capacitive probe with a pair of fixed flanking inductive posts.

13 Claims, 4 Drawing Sheets

APPARATUS AND METHOD FOR IN-PROCESS HIGH POWER VARIABLE POWER DIVISION

This application is a divisional application of U.S. Ser. No. 09/871,839 filed Jun. 1, 2001 entitled Apparatus and Method for In-Process High Power Variable Power Division, which application issued into Harris U.S. Pat. No. 6,741,143 B2 on May 25, 2004.

FIELD OF THE INVENTION

This invention relates to a compact, high power continuously variable power divider network or system for Radio Frequency ("RF"), microwave, or other high energy electromagnetic treatment systems (microwave).

BACKGROUND OF THE INVENTION

High Power microwave and radio frequency networks are used to provide energy for heating, curing, sterilizing, cooking, medical imaging, medical therapy, plasma generating, and other processing of substrates or treated media. The goal for such processing is to optimize the process. This processing can include multiple locations for a single generator, thus requiring some sort of power division. This typically means utilizing the minimum amount of energy to completely process two or more substrates from a single electromagnetic source in an efficient manner while, at the same time, greatly enhancing the quality and yield of the final product. The applications are primarily high power microwave and/or radio frequency energy utilization including the engineered wood industry, the food service industry, medical applications, heating and processing of manufactured products such as composite material production, the hydrogenation of petroleum products for octane boosting, plasma systems for the electronics industry as well as others.

In a typical device, an electromagnetic generator is located at a differing location in respect to a waveguide from its load. The waveguide itself can have a rectangular, circular, or other cross section, the section of which is dependent on the system design and desired mode or electromagnetic field map within the system, network or component.

Power division and/or power divider networks and systems are used to split portions of high energy signals that are supplied by the electromagnetic generators for application to several different parts, portions or locations within a system using electromagnetic energy for processing, depending on the requirements of the process. Depending on the specific requirements of the process, the power division ratios are or need to be set and/or adjusted according to these requirements. The power divider itself is selected in consideration of the waveguide and mode.

In the power divider networks of prior design, the power division ratio is permanently set by mechanically positioning an inductive and/or capacitive structure in the network such that the impedances of each of the multiple output ports, as seen from the perspective of the electrical center of the network, achieve the desired power division ratio. The power division ratios would thus be set permanently during the manufacturing process. This design has the disadvantage that, once it is set (typically in the measurement laboratory), the power division ratio can not be easily altered. This is especially so during operation of the device. Indeed, one of the only practical methods of altering or adjusting the power division ratio(s) is to actually physically remove the junction power divider network from a system where the power division ratio is a necessary parameter, and installing a completely new and different power divider with a different power division ratio.

BRIEF DESCRIPTION OF THE PREFERRED EMBODIMENT

In the present invention, the division ratio is adjusted by selectively variable capacitance probes located in respect to one of two or more outputs and a single input 13. Preferably, a capacitance probe is utilized in each output (two disclosed). The probes accomplish the power division by the resistance they create, with a larger resistance lowering the power through its respective output. The preferred impedance distribution and matching post (impedance post) 14 facilitates the power division by providing a matching balancing function as later described. The adjustment of the preferred two probes 25, 26 further preferably are made simultaneously from an initial division ratio at initial design positioning through a differing division ratio range. This maintains overall efficiency while allowing for differing power outputs. Also, by synergistically altering the sizing and location of the various components, the respective power division ratio can be modified (for example by modifying one probe's diameter or the divider post's position). Further, other factors such as mode, aspect, etc. can also be modified (for example using an applicator on one of three outputs or having only two of three outputs adjustable). Other modifications are also possible without deviating from the invention as claimed herein.

OBJECTS AND SUMMARY OF THE INVENTION

Microwave and RF processing can be used in a large variety of applications, some of which have been described above. This particular invention covers a new, simple, cost effective implementation of an electromagnetic network that can tolerate extremely high power electromagnetic field levels that are commonly required in industrial and scientific microwave and RF systems while, at the same time, provide a means, under manual, motorized or motorized-automatic control, to selectively adjust the power division ratio between the output ports of the network, while at the same time, maintaining a low voltage standing wave ratio ("VSWR") presented at the input port of the invention. The need to adjust or vary this power division ratio frequently accompanies many radio frequency or microwave process.

It is an object of this invention to simplify power division waveguides;

It is another object of this invention to reduce power reflection in power division devices;

It is a further object of this invention to optimize power transfer in division networks;

It is an object of this invention to increase the efficiency of processes that require differing ranges of power division ratio(s);

It is another object of this invention to provide a means of adjusting the network, while microwave or radio frequency power is being applied, to provide equal, or unequal power division ratios;

It is a further object of this invention to provide a means of adjusting the power division ratio between two output ports so as to allow a higher output microwave or RF power from one output port, and a lower microwave or RF power from the other output port to be adjusted in a manner that is required for an RF heating or processing system so as to add this control parameter and make it available to controllers of the overall process;

Other objects and a more complete understanding of the invention may be had by referring to the following drawings in which:

DETAILED DESCRIPTION OF THE INVENTION

Figure 1:
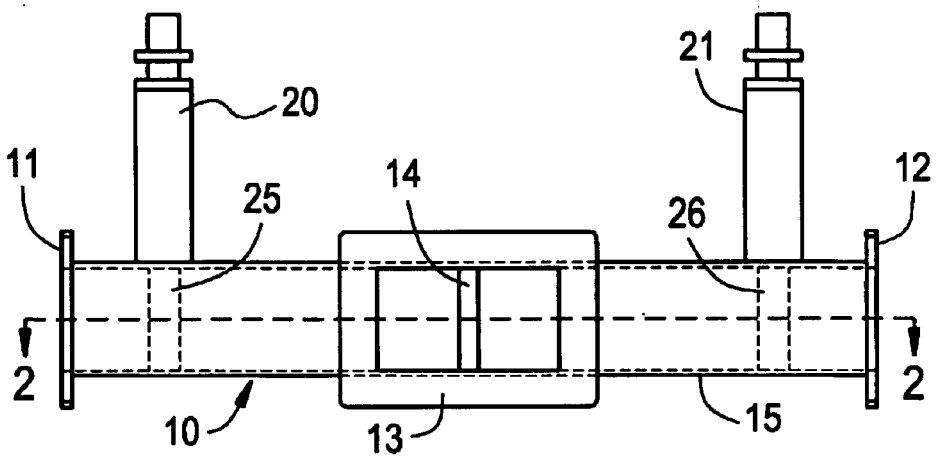
FIG. 1 is a longitudinal cross-sectional side view of a rectangular waveguide power divider section incorporating the invention.

There are many applications emerging where high power microwave and radio frequency energy is used, implementing much more complete, efficient and thorough processing required for a large variety of commercial, industrial, medical and research applications. Some of these applications include heating, curing, processing, sterilizing, medical imaging, medical therapy, plasma generation for the production of integrated circuits, as well as for many other applications and purposes. Other applications include processes such as microwave enhanced chemistry for still a further and more diverse application base. Some of the applications require the surmounting of a number of engineering obstacles. One particular requirement that frequently faces microwave physicists, engineers, designers and process technologists is the requirement for the ability to alter the power outputs between a number of waveguide sections within a complete system. This can be referred to as the system power division ratio. In most processes, power division ratios are set once during the manufacture of the physical waveguide or coaxial power division network.

This present invention covers a new network that can be used in a system to implement a means to dynamically adjust power division ratios within a system that utilizes microwaves or other high power electromagnetic energy (microwave). This allows the operators of a particular process to further adjust the application of high power electromagnetic energy to each output so as to produce a further enhanced result.

In the present invention, inductive members are utilized in addition to a capacitive member in order to vary the resistance in respect to a given output, thus changing the power of energy passing therethrough. This provides a power division for the network by altering the actual power through the outputs, directly through the given output and indirectly by changing the power available to other outputs. This electromagnetic network can tolerate the extremely high power electromagnetic field levels that are commonly required in microwave systems, while at the same time, synthesizing, under automatic control or manually, all of the required electrical parameters necessary to compensate for the changing characteristics that almost always accompany the alteration of any radio frequency or microwave process.

The preferred embodiment of this invention utilizes one single capacitive probe positioned between two inductive posts in each output of the device. The probes with their inductive posts are set at a specific distance from the center of the power dividing junction, depending on the waveguide size, waveguide type, and operating frequency and band. This distance is specifically adjusted so that the predominantly real portion of the complex impedance from each of the power divider outputs is presented to the power dividing junction at the center of the invention. The power division ratio is determined by the ratio of the reciprocal of these resistive impedances, as set by the capacitive probes, that is presented to the center of the power dividing junction, from each of the output ports. Each of these two impedances is adjusted using the capacitive probes so that the multiplied product of these two impedances, divided by the added sum of the same two impedances equals the characteristic wave impedance of the transmission line or waveguide comprising the power network. This controls the power from the respective outputs, while also maintaining a minimal input VSWR from the power divider over the power division range.

In the invention, the continuously variable power dividing network is directed to varying and controlling the power division ratio in the dominant waveguide mode or electromagnetic field wave propagation profile. Whatever the waveguide configuration, this network is preferably implemented using a capacitive probe/inductive post unit that is placed in the power divider section in the transmission path between the electrical center of the junction power divider and each of the output ports from the power divider network. The capacitive probes are mechanically actuated, either manually or by motor, in response to real time electrical measurement of the power division ratios and a comparison of that measured result with the process set point ratio, or by manually setting the division ratio intentionally, pragmatically, or theoretically. The exact nature of the probes depend on the waveguide shape and mode definition. Although the invention can be utilized with any shape of waveguide, it will be described in an example rectangular waveguide embodiment.

In this invention, an electromagnetic generator operates and supplies energy that travels along a transmission path including a waveguide to manipulate a number of process substrates (loads). In systems that use this electromagnetic energy, there is a requirement that the electromagnetic energy be split and distributed around to various parts and portions of the system using the electromagnetic energy according to certain split ratios. Traditionally, the transmission path power dividers are tuned and fixed to a specific pre-determined power division ratio, according to a specific process requirement.

This present invention provides a means to allow operators of a system utilizing electromagnetic energy to vary the power division ratios according to the requirements of a specific process requirement, thus providing for a much more flexible and universally tuneable system. This also allows a given waveguide to be adapted more easily to a variety of differing loads/applications. This can reduce manufacturing/inventory costs.

Figure 8:
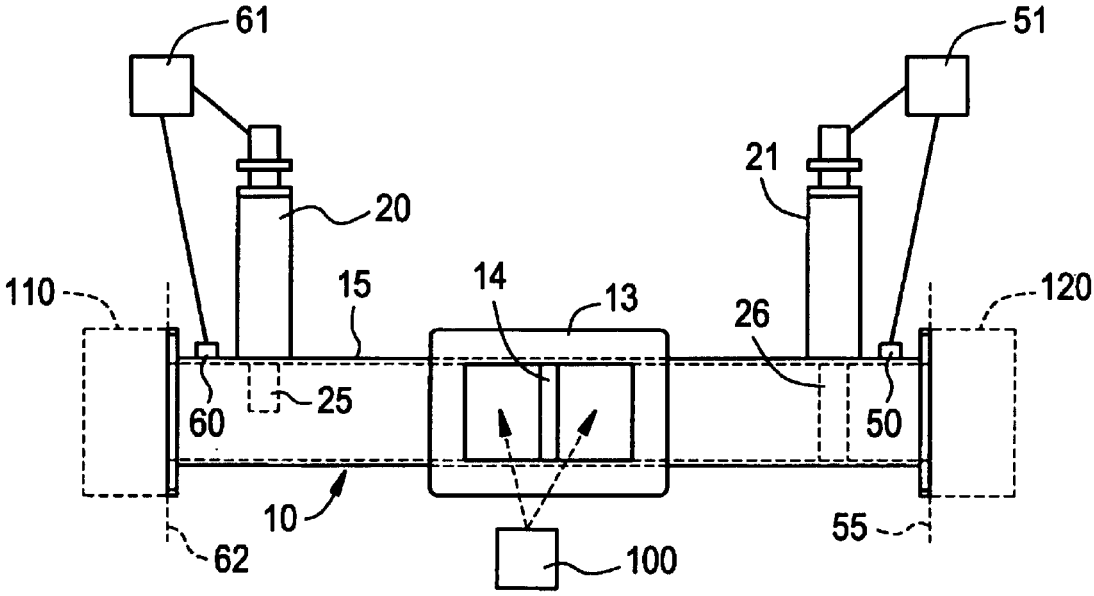
FIG. 8 is a drawing of a representational microwave network controlled by the invention; and, FIG. 9 is a diagram of a bolt hole pattern standard for the mounting flanges in the preferred embodiment disclosed.

A microwave source 100 is the preferred source of electromagnetic energy for the device (FIG. 8). Typically, this will be a 915 MHz or 2450 MHz U.S. standard microwave source. It may vary from different frequencies, for example, from 10–10,000 MHz. However, the invention can be used at frequencies higher or lower than this range. The power of the microwave source is not limited to any particular extent (except maybe by the physical parameters of individual components). The purpose of the electromagnetic energy source is to provide the energy to process the load. Energy reflected back from the waveguide to the source is absorbed as heat, typically in a dummy load (such as water).

The loads 110, 120 are the application wherein the energy from the electromagnetic source 100 is actually utilized. The basic attribute of these loads is that they absorb the energy from the electromagnetic network and preferentially transform it into another type of energy, typically heat. This transformation operates on the load to alter the state of the load from one level to another level as per a particular design application. For any given system there are two or more loads. It is preferred that loads are retained to be constant particularly in respect to reflected impedance by an intermediate tuner or otherwise. This preferably retains the reflected impedance of the loads at known levels. The location of a tuner(s) between the outputs and the loads preferably accomplishes this.

In the embodiment disclosed, the optimization tuners 55, 65 between each load 110, 120 and its respective output and the loads retain such loads themselves at a constant level, particularly in respect to reflected impedance. (Tuners by themselves without a divider would not be a solution due to the narrow bandwidth, the multiplicity and preciseness of required adjustments together with the size and complexity of the resultant device.) A modern optimization tuner is set forth in Harris U.S. Pat. No. 6,075,422 entitled Apparatus For Optimization Of Microwave Processing Of Industrial Materials And Other Products. This tuner uses optimization of resistance and reactance to provide tuning. This Harris patent is assigned to RF Technologies Corporation, the same assignee of this current application. This type of tuner can provide a constant load for each output, while recognizing that particular power division ratio may vary due to the operation of the divider.

The waveguide divider 10 interconnects the electromagnetic source 100 with the loads 110, 120. The waveguide divider 10 itself is designed to contain the power of the electromagnetic source., thus to transfer the power thereof to the loads. It also can aid in defining the mode definitions for the network. In this respect, also note that an applicator or other modifier may be included between the electromagnetic source and the waveguide divider 10 and/or the waveguide divider and the load(s) in order to transform from direct to angular, from one aspect to another (such as rectangular to circular), or otherwise as desired for a given application (in this respect it is noted that it is not necessary that the modifiers be symmetrical for all outputs and/or loads). The reason for this is to allow for common components and parameters to be utilized in a single divider for various individual applications.

In the example preferred embodiment, a single waveguide 15 is utilized. In this power divider network, the signal from the source 100 is fed into the input port 13 of the power divider 10 then to be split between the two output ports 11, 12. For example, if the impedance of each of the two output ports 11, 12 of the power divider is identical or the same, the power division ratio is even (i.e., 50/50). Preferably, the non-isolated junction power dividers of the type described herein contain an impedance transforming structure that will provide an impedance at the input port that will match the characteristic impedance, or characteristic wave impedance of the line or waveguide connected to the input port of the power divider network 10. This ensures a low percentage of reflected power or VSWR from the input port of the power divider.

In the preferred embodiment, the impedance to the input port is initially established and controlled by the impedance presented by an impedance post 14. This post 14 also aids in establishing an initial power distribution from each of the two output ports at given resistance thereof. The impedance post 14 is included also to increase the frequency bandwidth of the divider network as well as its predictability. This is important with commonly available microwave generators, particularly at lower powers.

Since the two output ports 11, 12 of the power divider 10 are connected in parallel, the resulting input impedance should be essentially equal to the product of the two impedances divided by their sum. When this impedance is maintained, this will ensure that the input port VSWR is also maintained.

Figure 2:
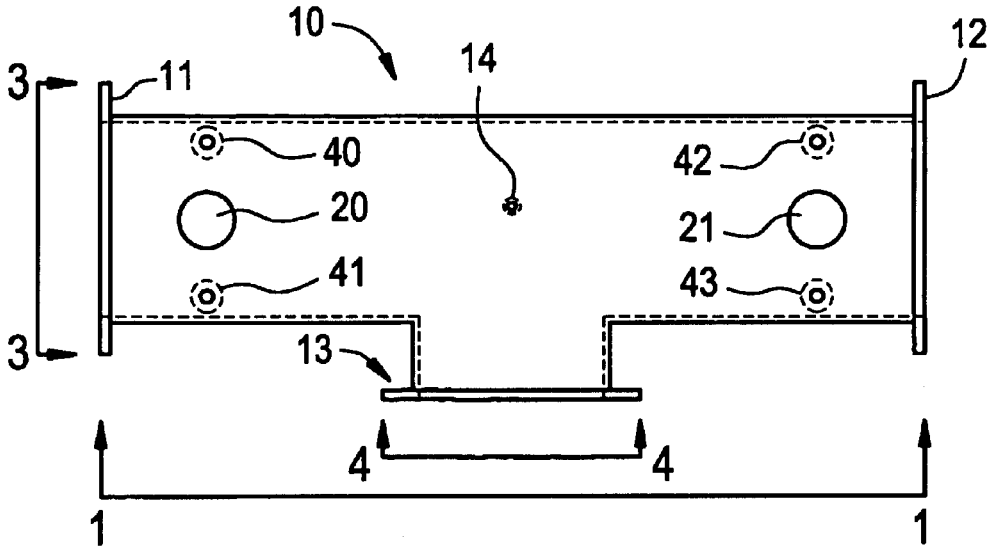
FIG. 2 is a longitudinal cross-sectional top view of a rectangular waveguide power divider section of FIG. 1.
Figure 9:
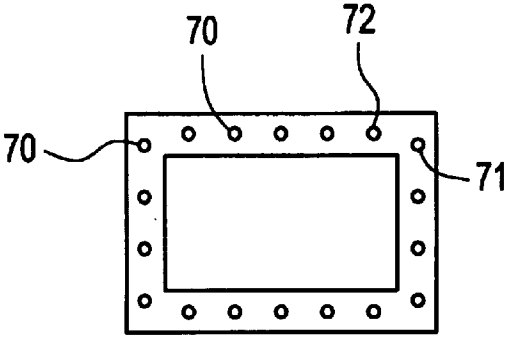
Figure 5:
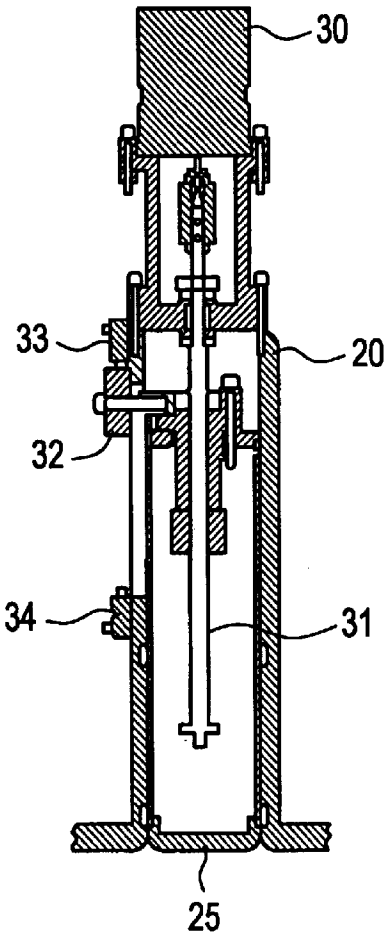
FIG. 5 is a cut-away side view of a variable capacitance probe usable with the power divider section of FIG. 1.
Figure 3:
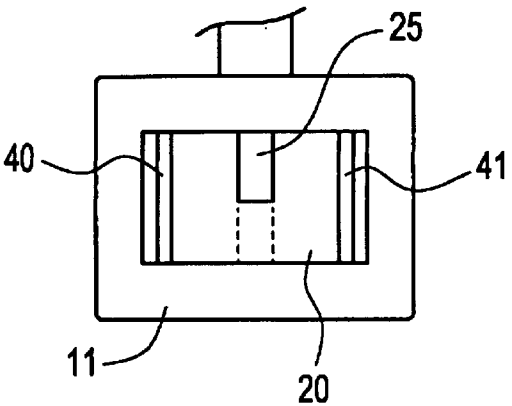
FIG. 3 is an end view of an output of the waveguide of FIG. 1.
Figure 4:
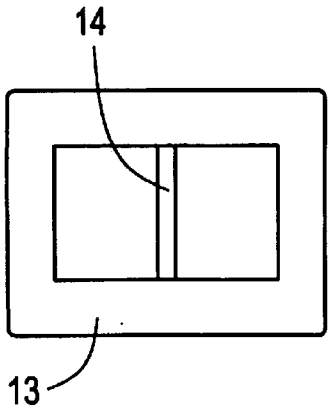
FIG. 4 is an end view of the input of the waveguide of FIG. 1.

In the example preferred embodiment, a rectangular waveguide 15 is utilized in the power divider 10. Located on opposing sides of the impedance post 14 are probe units 20, 21 (FIGS. 1–3). In this embodiment these probe units 20, 21 have alterable probes 25, 26 which extend into the waveguide 10. The selective movement of the probes selectively alters the various electromagnetic properties of the electromagnetic waves passing therethrough, particularly the resistance presented to the power dividing junction. This is preferred in that it allows for the selective modification of the power division ratio (for example with an input of 100% power each probe unit 20, 21 may be adjusted for a desired division power ratio, a ratio that preferably also equals 100%, 50-50, 70-30, 79-21, etc.). This allows for the efficient transfer of power within the waveguide between source and loads including at varying ratios with minimum reflection from the power divider itself. It is further preferred that the probe units be selectively adjustable to vary each individual output, further preferably simultaneously, so as to maintain the same input/output efficiency (for example with both probes selected to have a certain division at their midpoints (50/50) generally increasing the power of one output from 50–60% by withdrawing one probe while decreasing the other output from 50–40% by inserting the other probe would maintain an overall load of substantially 100% on the source, but with a different division factor). The actual division ratios would be designed for a given application to optimize same.

This preferred embodiment of the present invention embodies at least two probe units that control a plurality of microwave or radio frequency components, uniquely configured so as to provide both the inductive and capacitive adjustment capability that is required for universal match adjustment (FIGS. 1–3). In the preferred implementation, these two necessary parameters are controlled at exactly the same relative electrical position on the waveguide 15 (transmission line). The reason for this is the inclusion of inductive posts along with the capacitive probes. Each probe unit can thus provide adjustment embodying both inductive and capacitive reactance or susceptance from its single physical and electrical position. These two required electrical parameters are thus available so that proper adjustment of the match quality is present and can be maintained. This is preferred.

The power dividing junction between output ports may be any junction of waveguide or transmission line where electromagnetic energy is divided from an input port and distributed between a number (typically two) of output ports. The example herein includes the post 14. This post matches the electrical impedance presented to the input port 13 at or near the operating frequency to the characteristic impedance or characteristic wave impedance of the waveguide or system, providing a low VSWR. In this embodiment, it also provides a known amount of electromagnetic energy that is initially distributed to the two output ports 11, 12 while, at the same time, In the preferred embodiment disclosed, in order to accomplish the variable power division while, at the same time, maintaining the required match presented by the input port 13 of the invention to the characteristic impedance or characteristic wave impedance of the waveguide or system, probe units 20, 21 are incorporated into the system. Such probe units have movable probes 25, 26 which extend into the waveguide 15, in order to alter the various electromagnetic properties of the electromagnetic waves passing therethrough. These two capacitive probes 25, 26 each are positioned between two inductive posts 40, 41 & 42, 43, that are located longitudinally at the same electrical position as the physical and electrical center of the adjustable capacitive probes 25, 26. The capacitive probes 25, 26, will contribute capacitive reactance. The inductive posts 40, 41 & 42, 43 will contribute inductive reactance. These two electrical parameters are vector quantities, each with directions that are nearly opposite from one another, thereby adding destructively. The capacitive probe units 25, 26 placed in between the two inductive posts 40, 41 & 42, 43 can therefore be adjusted such that the capacitive reactance that is introduced by the capacitive probe units 25, 26 will cancel the inductive reactance that is contributed by the inductive posts 40, 41 & 42, 43. The result is a shunt parallel resonant circuit, whose shunt resistive impedance is extremely high, resulting in very little alteration to the waveguide wave impedance resulting therefrom.

Figure 6:
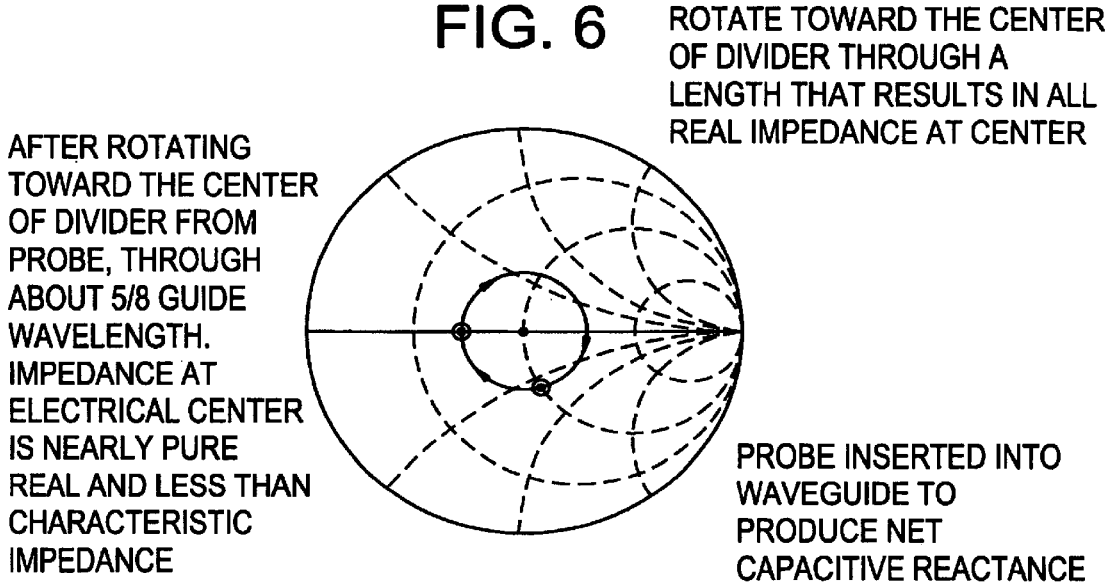
FIGS. 6 and 7 are impedance diagrams disclosing the higher-than-wave-impedance and the lower-than-wave-impedance adjustment range of the of the preferred embodiment of the invention.
Figure 7:
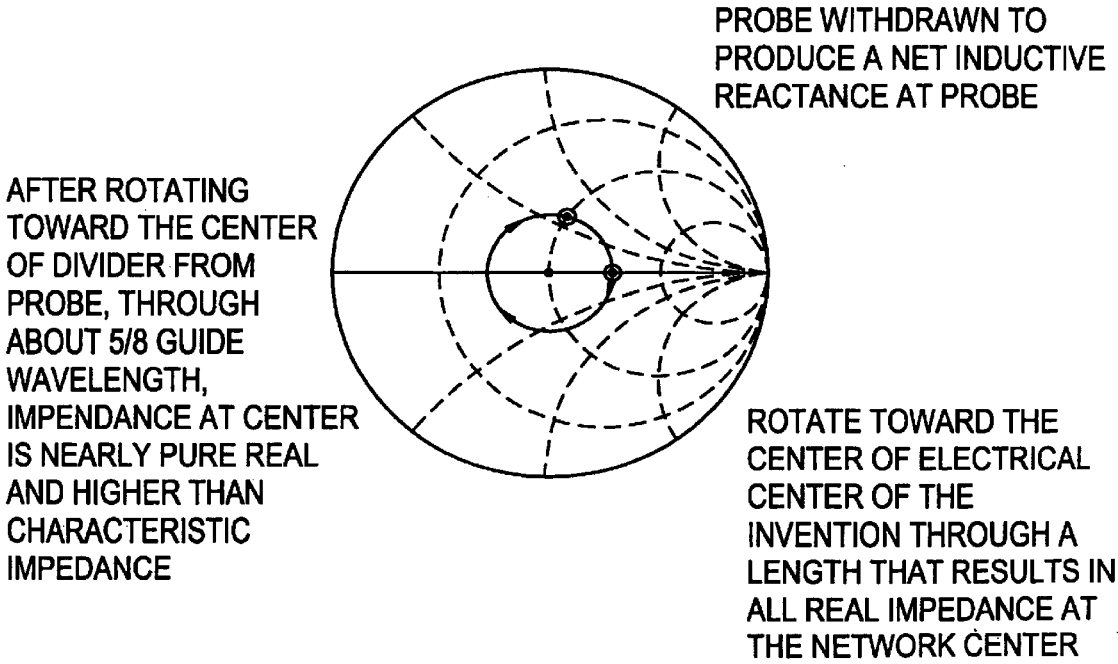

The two probe units 20, 21 and an impedance distribution and matching post 14 herein are each placed at specific points with regard to the electrical center of the power dividing junction, according to the physical dimensions of the waveguide, operating mode and frequency of operation. Probe units 20, 21 disclosed are located in each output leg at a distance approximately equal to 85–96% wavelength in the waveguide, within 0.3, of the center frequency of the operating bandwidth from the electrical center of the power dividing junction (91% and 0.1 preferred respectively). Such waveguide controls a plurality of microwave or radio frequency components, uniquely configured so as to provide both the inductive and capacitive adjustment capability that, when propagated through the waveguide sections from the probe units 20, 21, back to the electrical center of the power dividing junction, the impedance presented from each output leg back to the power dividing junction is nearly purely resistive in nature, due to the rotation of the reflections from the capacitive probe 25, 26 and the inductive posts 40, 41 & 42, 43 through the 91% of a single waveguide wavelength, displaced between the electrical center of the power dividing junction and the electrical center of the capacitive probes 25, 26, and inductive posts 40, 41 & 42, 43 (see FIGS. 6, 7).

In the preferred implementation, the necessary electrical parameters from the capacitive probe can be adjusted to produce either no net reactance by adjusting an example capacitive probe 25, such that the capacitive reactance from the probe equals the inductive reactance from the two posts 40, 41; or to produce a continuously adjustable level of net capacitive reactance by inserting the capacitive probe 25 into the waveguide, (or transmission line), to positions beyond the point where the capacitive reactance from the probe equals the inductive reactance from the two posts 40, 41; or to produce a continuously adjustable level of net inductive reactance by withdrawing the capacitive probe 25 out of the waveguide 15 (or transmission line), to positions beyond the point where the capacitive reactance from the probe equals the inductive reactance from the two posts 40, 41. By adjusting the capacitive probe 25 to positions deeper inside of the waveguide 15, producing a net capacitive reactance from that capacitive probe/inductive post set, and then rotating the phase of this net capacitive reactance through approximately 91% of a waveguide wavelength by allowing the electromagnetic energy to propagate through the approximate 91% waveguide wavelength toward the electrical center of the power divider junction, the resultant impedance that appears at the junction point of the power divider will appear resistive in nature and will be lower than the characteristic impedance or the characteristic wave impedance of the system. At the same time by adjusting the capacitive probe unit 26 on the other output port of the power divider, to positions shallower than that position where the capacitive reactance from the probe unit 21, equals the inductive reactance from the two posts 42, 43, this will produce a net inductive reactance from that capacitive probe/inductive post set 26, 42 & 43, and then rotating the phase of this net inductive reactance through approximately 91% of a waveguide wavelength by allowing the electromagnetic energy to propagate through the approximate 91% waveguide wavelength toward the electrical center of the power divider junction, the resultant impedance that appears at the junction point of the power divider will appear resistive in nature and will be higher than the characteristic impedance or the characteristic wave impedance of the system. Adjustment of the two probes may be simultaneous and such that the numerical value equal to the product of these two resultant impedances divided by a numerical value equal to the sum of these two resultant impedances as presented at the center of the power dividing junctions will equal the characteristic impedance or characteristic wave impedance of the system, resulting in a continued maintenance of a well matched input to the power divider 14, while at the same time, providing a means of adjusting the amount of power that is delivered to each of the two outputs of the invention.

The impedance post 14 has a diameter of approximately 4.0–5.0% of a waveguide wavelength and is located approximately 3.4–4.3% of a wavelength in the waveguide, both within 0.3, of the center frequency of the operating bandwidth beyond the electrical center of the power dividing junction from microwave source 100 and equidistant between probe units 20, 21 (4.4% preferred respectively both within 0.1). This provides the desired characteristic impedance to the microwave source set forth, minimizing input VSWR. It also aids in distributing equal amounts of power to each of the two probe units 20, 21. Adjustment of the output balance may be achieved without manipulation of probe units 20, 21 by moving the post 14. The location of impedance post 14 with respect to probe units 20, 21 and the electrical center of the power dividing junction can therefore aid in determining the relative amount of power directed towards signal output ports 11, 12. The reason for this is that placement of the post 14 laterally across the input port 13, the impedance post 14 will provide a greater percentage to a more distant probe unit. Thus, moving the impedance post 14 towards probe unit 20 would result in more power being directed towards signal output port 12. The amount of power delivered to the signal output port may be further modified by adjustment of capacitive probes 25, 26. For example, if post 14 were located such that 90% of the power were directed to signal output port 11 and 10% to signal output port 12, the capacitive probes 25, 26 could be adjusted to deliver between 80–100% and 20–0% of the power to signal output ports 11 and 12, respectively. The impedance post 14 is preferably located within the area described by a circle of origin at the electrical center of the power dividing junction and radius 3.5". The preferred embodiment of this invention favors even distribution of the power by waveguide 15 as such arrangement allows greater control by probe units 20, 21.

In the example device, the probe/post units are incorporated into a waveguide 15. This is preferred as reducing the number of parts contrasted with having a separate section from the waveguide 15.

The specific waveguide 15 disclosed is designed for 915 MHz with 100 Kw power capacity. It is substantially rectangular in shape, 48" long, 9.75" wide, and 4.875" high between the two output ports 11, 12 (32.14 between center probes 25, 26) (inside dimensions). An extension 4" long, 9.75" wide, and 4.875" high extends on the centerline of the waveguide 15 to form the input port 13 (again inside dimensions).

Mounting flanges some 1.75" wide extend about all ports 11, 12, 13. Such flanges have an outside dimension of 13.25" wide by 8.38" high. The flanges are designed to selectively couple the waveguide to components (such as loads 110, 120 and generator 100) by means of bolts inserted through holes in such flanges. In the specific embodiment described, each mounting flange is substantially planar and has one set of bolt holes along each aspect of the flange. There are a total of 18 bolt holes, each being some 0.406" in diameter. The centers of such bolt holes are located 0.753" from the outside of flange and are spaced 2" apart. The first vertical bolt hole 71 is displaced 0.437" from the centerline of the horizontal bolt holes; the first horizontal bolt hole 72 is displaced 1.875" from the centerline of the vertical bolt holes. These flanges facilitate assembly of a network as well as providing for a measure of universality for differing networks.

The impedance distribution and matching post 14 is located on the centerline of the input port 13 displaced 0.670" behind the centerline of the waveguide between the two probes 20, 21 along the length of the waveguide 15. The post 14 itself is 0.750" in diameter extending from the full height of the waveguide 15. The two probes 20, 21 have axial centerlines each some 15.65" from that of the post 14 and 8" off of the two ends of the waveguide 15.

The actual changing of the power division ratio is accomplished by the combination of capacitive probes 25, 26 and inductive tuner posts 40, 41 and 42, 43. In the particular embodiment disclosed, the inductive posts 40, 41 & 42, 43 are all round aluminum bars some 1+½" in diameter and 4.870" long. The posts are each 1" from the adjoining wall of the waveguide 15, separated from each other by 7.75". The edge contact surface of the posts are each about 0.075" with a relief having a depth of about 0.030" comprising the rest of the surface. This is to ensure secure electrical contact to transform the high surface currents that pass along the outer surface of the inductive posts (skin effect). These inductive posts 40, 41 & 42, 43 are located in pairs 40, 41 & 42, 43 separated from components along the transmission line axis by at least 1½ waveguide wavelength to prevent interference.

Located between the inductive posts 40, 41 & 42, 43 are the adjustable capacitive probe units 20, 21. The probe is fabricated of brass and then silver plated for high electrical conductivity. Each capacitive probe includes a movable probe 25, 26 some 2.75" wide and 6.45" long. The end of the probe is machined to a radius of about 0.250" to diffuse the concentration of fields. This probe 25, 26 is moved under control of a stepper motor 30 and tuner screw 31 through a distance of substantially 2.64". A tripper 32 located between two microswitches 33, 34 acts as an over-travel relief mechanism to insure safe operation of the probes, preventing damage to the mechanism.

In other systems, the size, location, materials and distance of travel would need to be adjusted to insure proper operation of the device.

The quantity and quality of the preferred automatic movement of the probes 25, 26 can be under the control of a feedback network. This movement preferably adjusts the forward power for each output. This adjustment is aided in the preferred embodiment by the fact that each output load is relatively constant (due to the preferred intermediate timers), requiring primarily power adjustment to reflect differing process requirements for otherwise non-varying loads.

The preferred feedback network consists of a sensor 50, 60 and a computer 51, 61.

The sensor 50, 60 is designed to sense the properties of waves which exist within the device representative of the forward power for each output, preferably at a location between the electromagnetic source 100 and loads 110, 120.

The computer 51, 61 adjusts the system in order to adjust the energy division for the various processes associated with the device. This energy division may typically vary during operation of the device to optimize a given process. A single computer can be utilized if desired.

In respect to a power sensor (typically forward located between the electromagnetic source and the loads), the computer uses the input from the sensors to adjust the efficiency for a given individual load.

In the invention of this present application, the parameters for this power division are provided by an adjustable capacitive probe 25, 26 located between two parallel inductive posts 40, 41 & 42, 43 at the same longitudinal location in the waveguide 15, comprising the divider.

An additional sensor may be utilized on the input to minimize reflected power thereat. With this orientation, the electrical parameters can be tuned in order to minimize reflected energy, and thus match the electromagnetic field to the process. Other types of control are also possible.

In the preferred embodiment, the computers 51, 61 adjusting the probes 25, 26 by control of the stepper motor 30 of each unit 20, 21 in order to adjust the vector reflection coefficient for each unit thus to adjust the power division (and preferably counter-react the reflected energy). It thus adjusts the standing wave pattern to cancel ineffective radiation outward from the system.

Although the invention has been described in its preferred form with a certain degree of particularity, it is to be understood that numerous changes can be made without deviating from the invention as hereinafter claimed.

What is claimed is:

1. A power divider for a microwave waveguide having an input and multiple outputs, the divider comprising an impedance post, said impedance post being located in the waveguide between the input and at least two outputs, at least one power selective probe, said at least one power selective probe being respectively located in the waveguide between said impedance post and one of said at least two outputs, and adjustment means to selectively set said at least one power selective probe so as to alter the power through its respective output.

2. A power divider of claim 1 characterized by each of said first and second power selective probes each comprising a capacitive probe, said capacitive probe being flanked by a pair of inductive members, and each pair of said inductive members extending across the lateral cross section located on either side of said capacitive probe.

3. A power divider of claim 1 characterized by the distance between said impedance post and each of said first and said second power selective probes being within 0.1 of 91% of the wavelength in the waveguide at the center frequency of the operating bandwidth.

4. A power divider of claim 1 wherein said at least one power selective probe is variably altered by an adjustment means.

5. A power divider of claim 1 characterized in that at least one of said power selective probes is located at least 1.5 wavelength in the waveguide within 0.1% of the center frequency of the operating bandwidth from any component located along the longitudinal axis of the waveguide.

6. A power divider of claim 4 characterized by said alterations being preset by physical replacement of said at least one power selective probe.

7. A power divider of claim 1 characterized by two outputs.

8. A power divider of claim 1 characterized by the distance between said impedance post and said at least one power selective probe being within 0.1 of 91% of the wavelength in the waveguide at the center frequency of the operating bandwidth.

9. A power divider of claim 8 further characterized by the distance between said impedance post and said at least one power selective probe is 91% of the wavelength in the waveguide at the center frequency of the operating bandwidth.

10. A power divider of claim 1 characterized by said impedance post having a diameter, said diameter being 4.4% of the wavelength in the waveguide at the center frequency of the operating bandwidth.

11. A power divider for a microwave waveguide having an input and two outputs, the divider comprising an impedance post, said impedance post being located in the waveguide between the input and at both outputs, a first power selective probe, said first power selective probe being respectively located in the waveguide between said impedance post and a first of the outputs, adjustment means to selectively set said first power selective probe so as to alter the power through its respective first output, a second power selective probe, said second power selective probe being respectively located in the waveguide between said impedance post and a second of the outputs, and selective means to selectively set said second power selective probe so as to alter the power through its respective second output.

12. A power divider of claim 11 characterized by said impedance post having a diameter, said diameter being 4.4% of the wavelength in the waveguide at the center frequency of the operating bandwidth.

13. A power divider for a microwave waveguide having an input and multiple outputs, the divider comprising an impedance post, said impedance post being located in the waveguide between the input and at least two outputs, a first power selective capacitive probe, said first power selective capacitive probe being respectively located in the waveguide between said impedance post and a first of said outputs, selective means to selectively set said first power selective capacitive probe so as to alter the power through its respective first output, said first capacitive probe being flanked by a first pair of inductive members, each first pair of said inductive members extending across the lateral cross section located on either side of said first capacitive probe, a second power selective capacitive probe, said second power selective capacitive probe being respectively located in the waveguide between said impedance post and a second of said the outputs, selective means to selectively set said second power selective capacitive probe so as to alter the power through its respective second output, said second capacitive probe being flanked by a second pair of inductive members, and each second pair of said inductive members extending across the lateral cross section located on either side of said second capacitive probe.

* * * * *